US008002117B2

(12) United States Patent
Van de Laak et al.

(10) Patent No.: US 8,002,117 B2
(45) Date of Patent: Aug. 23, 2011

(54) METHOD AND APPARATUS FOR SORTING A GAS-DRIVEN STREAM OF GENERALLY FLAT AND LIGHTWEIGHT ARTICLES

(75) Inventors: Thomas Marinus Antonius Van de Laak, Best (NL); Mario Martin, Treviso (IT); Robertus Cornelis Van Hoek, Vlijimen (NL)

(73) Assignee: Comas, S.p.A., Silea (Treviso) (IT)

( * ) Notice: Subject to any disclaimer, the term of this patent is extended or adjusted under 35 U.S.C. 154(b) by 468 days.

(21) Appl. No.: 11/666,393

(22) PCT Filed: Oct. 19, 2005

(86) PCT No.: PCT/EP2005/055365

§ 371 (c)(1), (2), (4) Date: Apr. 26, 2007

(87) PCT Pub. No.: WO2006/048376

PCT Pub. Date: May 11, 2006

(65) Prior Publication Data

US 2008/0087583 A1 Apr. 17, 2008

(30) Foreign Application Priority Data

Nov. 1, 2004 (EP) ..... 04105438

(51) Int. Cl.
*B07C 5/00* (2006.01)

(52) U.S. Cl. ..... 209/639; 209/265; 209/906; 209/915; 209/644

(58) Field of Classification Search ..... 209/638, 209/639, 644, 537, 21, 22, 23, 24, 25, 26, 209/27, 915, 906
See application file for complete search history.

(56) References Cited

U.S. PATENT DOCUMENTS

| | | | | | |
|---|---|---|---|---|---|
| 3,826,065 | A | * | 7/1974 | Labbe | 55/309 |
| 3,968,366 | A | | 7/1976 | Asfour | |
| 4,657,144 | A | * | 4/1987 | Martin et al. | 209/546 |
| 4,832,058 | A | * | 5/1989 | Labbe | 131/110 |
| 4,895,174 | A | * | 1/1990 | Henderson et al. | 131/110 |
| 4,909,930 | A | * | 3/1990 | Cole | 209/564 |
| 4,915,824 | A | * | 4/1990 | Surtees | 209/139.1 |
| 5,267,576 | A | * | 12/1993 | Heitmann | 131/84.1 |
| 5,305,893 | A | | 4/1994 | Hereford | |
| 5,460,189 | A | * | 10/1995 | Coleman et al. | 131/109.2 |

(Continued)

FOREIGN PATENT DOCUMENTS

| | | |
|---|---|---|
| DE | 3428966 | 2/1986 |
| DE | 10008961 | 9/2000 |
| EP | 1838464 B1 | 8/2009 |

*Primary Examiner* — Stefanos Karmis
*Assistant Examiner* — Ernesto Suarez
(74) *Attorney, Agent, or Firm* — Morgan, Lewis & Bockius LLP

(57) ABSTRACT

A method and apparatus for sorting a gas-driven stream of generally flat and light-weight articles of varying dimensions execute a, preferably optical, inspection and upon so finding a non-conforming article remove the latter from the stream. In particular, the inspection and the sorting are executed during a substantially straight movement of the articles. The removing is executed through gas driving in a direction substantially transverse to the straight movement. Advantageously, the inspection is preceded by orienting the articles through a centrifugal force that orients said articles against an inclined wall in a transition to the vertical movement. Also airflow means (83,84) can be used to confine the articles in a thin layer.

8 Claims, 6 Drawing Sheets

U.S. PATENT DOCUMENTS 5,791,489 A * 8/1998 Leifeld ..... 209/44.1
5,862,919 A 1/1999 Eason
6,374,998 B1 * 4/2002 Grubbs et al. ..... 198/836.2
6,510,855 B1 * 1/2003 Korte et al. ..... 131/96
6,542,234 B1 4/2003 Ulrich
2002/0175113 A1 * 11/2002 Tahkanen ..... 209/639
2005/0199252 A1 * 9/2005 Coleman ..... 131/110

* cited by examiner b a

METHOD AND APPARATUS FOR SORTING A GAS-DRIVEN STREAM OF GENERALLY FLAT AND LIGHTWEIGHT ARTICLES

BACKGROUND OF THE INVENTION

The invention relates to a method for sorting a gas-driven stream of generally flat and light-weight articles of varying dimensions through executing a, preferably optical, inspection and upon so finding a non-conforming article removing the latter from the stream. Such articles may result from production processes that are agriculture-based, or from other sources and a prime example for the products to be sorted are tobacco products such as leaves or parts cut therefrom or stems. Such products once packaged are transported, and then the products are handled for separating them again. Typical sizes for conforming particles of the product under consideration are without limitation lengths and widths in a range from 1 to 500 millimeters. Tobacco is relatively quite expensive and the separated products may be accompanied by various matters of non-conforming tobacco character, as well as by various categories of non-tobacco origin, such as the successive stages of the production may introduce. It is noted here that "optical" means "radiative" and thus including the use of radiation that is not visible for the eye. Moreover, inspection by means of other techniques like by acoustic waves might be feasible.

Prior art has realized the technical and economic usefulness of automatic sorting, but the present inventor has recognized that an optimized set-up would need at least some, but not necessarily all of the following features:

- inspection with one or more relatively straightforward line-scan camera(s) arranged across the direction of motion of the articles;
- orienting non-conforming articles in such manner that the detection device(s) will find the largest area of the article in question, whilst using only few or no moving parts for introducing and maintaining such orientation;
- article motion and gas speed being adjustable and relatively uniform, in that relatively low speed will allow easy data processing, whereas higher speed will increase throughput, and requiring only few moving parts for attaining a low noise level;
- a possibility for designing the apparatus through a substantially closed channel, also for keeping environmental dust level at low values; especially for a product like tobacco this is of great benefit;
- removing the non-conforming matter through an under-pressure facility that connects to the channel;
- executing inspection and separation during substantially straight, in particular vertical, motion, inasmuch as such would tend to maintain particle orientation; a
- free fall would be most advantageous, as such would tend to produce uniform particle speeds, especially in combination with gas-suction for particle removal;
- and keeping the risk for jamming of the overall apparatus at an acceptably low value.

Now in particular, U.S. Pat. No. 5,862,919 to Eason discloses the sorting of particles through feeding thereof by a horizontal conveyor belt, while separating both conforming and non-conforming articles through selectively activating a gas ejector during a falling trajectory of the particles, which trajectory will always deviate appreciably from a straight line. The present inventor has found that a straight line motion during both the inspection phase and the transmittal phase of the conforming articles is better for accurate detection and accurate removal of the particles. Furthermore, free motion of the particles allows for double-sided visual inspection. Moreover, such could be combined with better orienting the particles before inspection, which should give superior results.

SUMMARY TO THE INVENTION

In consequence, amongst other things, it is an object of the present invention to provide a reliable method both on the level of the sorting proper and also on the level of overall operation.

Now therefore, according to one of its aspects, a method according to the invention is characterized according to the characterizing part of claim 1. Preferably the method is specifically dimensioned for sorting tobacco products such as leaves or parts thereof or stems. Preferably the inspection used is an optical inspection.

The invention also relates to an apparatus being arranged for implementing the method as claimed in claim 1, and in particular as claimed in claim 5. Further advantageous aspects of the invention are recited in dependent claims.

BRIEF DESCRIPTION OF THE DRAWING

These and further features, aspects and advantages of the invention will be discussed more in detail hereinafter with reference to the disclosure of preferred embodiments of the invention, and in particular with reference to the appended Figures that illustrate.

DETAILED DESCRIPTION OF PREFERRED EMBODIMENTS

Figure 1:
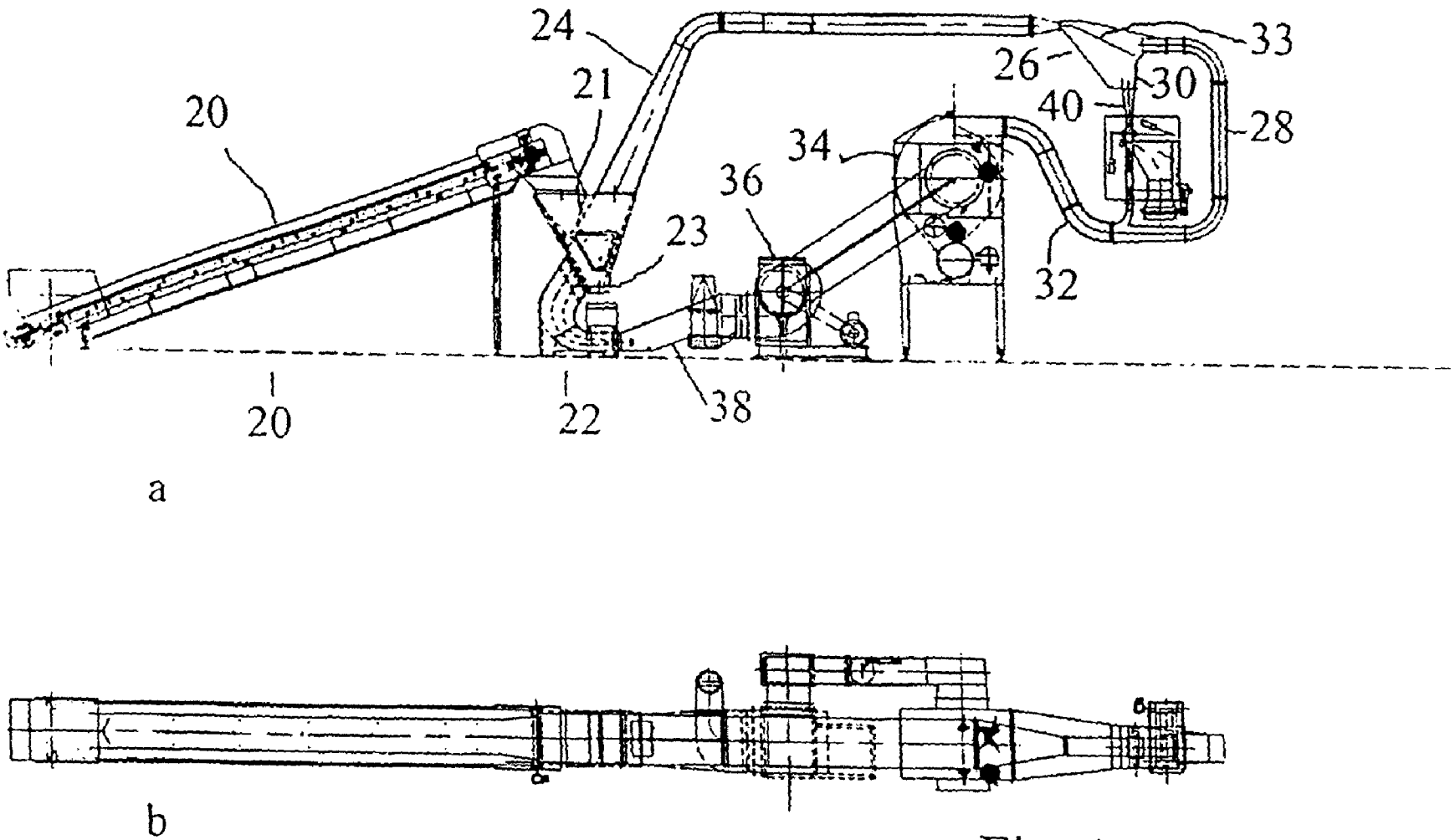
FIG. 1, an overall set-up of a sorting system according to the invention.

FIG. 1 illustrates in principle an overall set-up of a sorting apparatus according to the invention. It is to be noted that the installation configuration of the individual components of this set-up may be altered depending on the requirements (product, space, etc.), for instance when using the "open channel" organization (see further below). As shown, in this configuration the overall length of the machine is about 17 meters. Item 20 is a feeding conveyor belt that feeds the articles. The providing of the articles proper as resulting from splitting, etcetera, of the tobacco has not been shown for clarity. At indication 22, the articles fall from the conveyor belt and into the transport system that in this embodiment centers on a substantially closed air-carrying duct arrangement. To this effect, a feeding chute 21 opens towards the conveyor belt side, and particles will fall through this chute. The transporting air circulates through various openings in an inclined plate 23, although in principle, another gas or gas mixture could be used. The size and distribution of the openings and of other inlets, not shown in detail, would give an appropriate feeding speed for letting the articles or product travel independently from each other through the apparatus channel. Moreover, the net air exchange through chute 21 should be kept low to maintain both dust loss and also maintain air intake at low levels. One way to effect this is keeping the local internal air pressure of the system approximately equal to ambient air pressure.

At indication 24 a rising duct will carry the particle stream to an appropriate height, in this case some 5 meters; thereafter, the rising duct proceeds as a generally horizontal tube. At indication 26, the air duct is divided through an inclined and slowly slanting downwardly separation plate 33 that carries an air transmission pattern of holes. In this manner, part of the air stream can be diverted to bypass duct 28, while the particles of interest cannot pass through the holes. On the other hand, small and generally uninteresting particles such as dust can pass through these holes. This feature allows for adjusting the air speed below the separating plate. Air speed before the separating plate is in a range of 20-30 meters/second, while it is in the range of e.g. 10-20 meters/second in the area where the inspection takes place. Through a certain centrifugal force, the particles of interest are driven to the descending and subsequently, nearly vertical wall at indication 30, and generally tend to turn their broad area in a more or less horizontal direction to the right side in the Figure.

Both the centrifugal force and the air outletting through the plate can contribute to orient conforming particles. The result should be a monolayer of well-oriented "good" particles, so that a large fraction thereof will be accepted. On the other hand, the effect on "bad" particles need not be considered, inasmuch as the optical survey discussed hereinafter would be able to pick them out as being non-conforming. The inventor has found that the above manner of orienting the particles is inexpensive, uncomplicated, and has a high success rate.

Below indication 30, the separation of unwanted particles is effected during the substantially vertical motion of the particles, through optical inspection and then removal to the right (or alternatively, to the left, or in other directions) in an inspection/separation duct 40, which operation will be more clearly illustrated in FIG. 2. Although preferred to be vertical, the duct orientation, and therefore, the particle motion may have some deviation from vertical: it is contemplated that +/−15° would often be acceptable, and in any way, +/−5° would give a good solution. More or less similar deviations from a straight-line motion could apply. At indication 32, the stream with particles retained and the bypass stream 28 of air merge again. Downstream from indication 32, the useful particles are removed from the system in an air-operated product separator arrangement 34 for further processing not considered here. The air output of air-product separator 34 goes through further ducts and main driving air pump arrangement 36. Finally, the overall duct is attached at indication 38 to the particle feeding position discussed earlier. Generally, there is little loss of air, and therefore also little air suppletion will be necessary, so that the process as a whole takes place in a substantially closed system: the air will cycle several times before being exhausted with the useful particles at air-product separator 34 or via the air bleed-off pipe which is connected to the circuit as a standard going to an exhaust air treatment device. This lowers overall noise levels, and also lowers the risk of high dust concentrations outside the system.

Now, although the preferred embodiment as shown has the sorting during a falling motion of the particles, in principle other straight-line arrangements could operate in a satisfying manner. If the primary motion is horizontal, the removal of non-conforming particle could be effected in a substantially horizontal, in a substantially vertical manner, or according to still other orientations. If the primary motion is ascending or descending, various geometrical arrangements can be designed, also depending on the gas velocity, the size of the channel, the nature of the conforming and/or non-conforming particles, etcetera.

Figure 2:
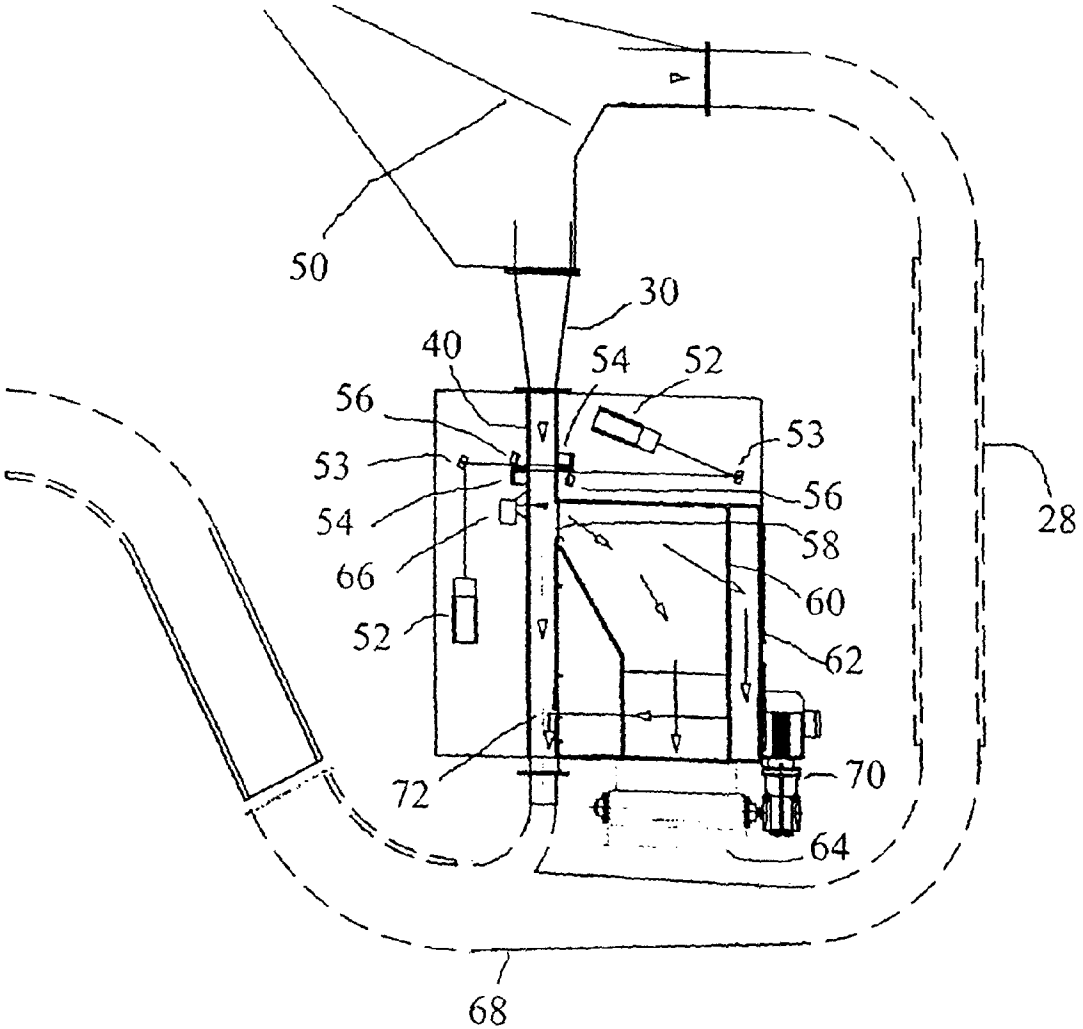
FIG. 2, an enlarged view of a part of a sorting facility proper, according to the invention.

FIG. 2 illustrates an enlarged view of a part of sorting facility proper according to the invention, showing in particular items 28, 30 and 40 of FIG. 1. In particular, note the downwardly inclined course at separation plate 50 (indicated with numeral 33 in FIG. 1), which lets the particles more or less "approach" the wall 30 at reduced air velocities in a range of 10 to 20 meters/second. Whereas the downward inclination of plate 50 shown in the figures is plane, said inclination preferably is cylindrically towards wall 30. The air flow through separation 50 would assist such "approach". The transition between the part at 50 and the selection facility proper should be short to maintain the particle orientation; in the embodiment it is about 10% of the total system height, or some 35 centimeters. The vertical part of the duct 40 has a more or less square or rectangular cross-section.

Now, the selecting proper is effected with double-sided background illumination sources such as lighting 56, double sided narrow beam particle lighting 54, double mirrors 53 and double-sided line cameras 52. In this way the particles can be made well distinguishable, in that the nature of the background can be made to stand out relatively distinctly from properties of the particle such as intensity and color. The output signals from the horizontal line of optical detection units such as cameras are processed in a processing facility not shown, which facility can measure particle shapes in appropriate manner, through correlating successive scans, measuring total exposed particle area, and rejecting such particles as considered non-conforming to the standard range of particle shapes. Through the relatively low air speed, the available data processing time interval can be kept sufficiently long for a moderate-power computer.

If the particle shape, and possibly color or other properties, are good, the particle proceeds downward in a vertical direction. If the particle is considered bad however, at indication 58 the particle will be removed by suction to the right. Through the suction by underpressure, no additional superfluous air motion and no unwanted turbulence will be introduced into the falling duct. The removal operation proper can be further effected or supported by a gas nozzle 66 that is momentarily activated for ejecting the particle through the opening at indication 58; this lets the non-conforming particle escape in a horizontal direction that is substantially across the primary motion of the particles before separation.

Like the vertical orientation of the inspection/separation duct 40, the removal can have some tolerance from horizontal, such as +/−15°. Anyway, right after the removal operation proper through output 58, gravity and/or principal air movement will make the rejected particle fall downward. In fact, at indication 60, a perforated plate separates the reject duct that goes to reject bin 64, whereas the bulk of the air stream through underpressure by pump 70 will at indication 62 be led to another part of the closed system or elsewhere. In an alternative embodiment said air stream might near indication 62 reenter bypass duct 28, and therefore remain as well in the overall system. At indication 68, the two principal streams 28,72 of air merge again. This merging can alternatively occur behind air-product separator facility 34, as in FIG. 1. For clarity, no extensive discussion of air-product separator facility 34 is given, inasmuch as the removing of particles by air-product separator activity is well-known to persons skilled in the art of air-driving particles in an industrial environment.

Figure 3:
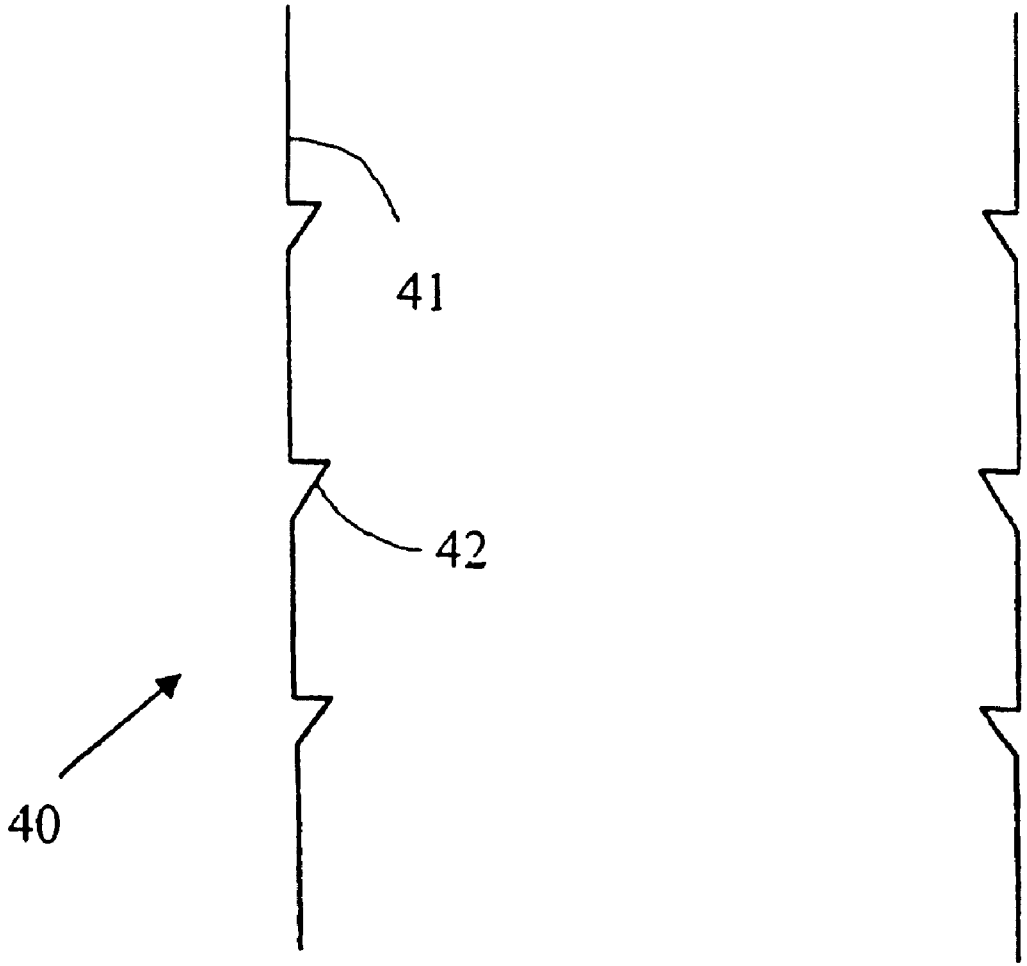
FIG. 3, an article carrying channel wall with extensions to keep the articles from moving along the channel wall.

FIG. 3 shows an article carrying channel wall 41 of duct 40 with extensions 42 to keep the articles from moving along the channel wall. It has been found that such will keep particle speed more uniform, so that the arrival of a particular particle at the position of nozzle 66 can be predicted more accurately. Indeed, the particles will not be delayed by extensive friction along the wall. The extensions will influence the boundary layer of the flowing gas and may look like fish scales. Their height (perpendicular to the wall) is in a range of 0.5 to 2.5 millimeters, whereas their area (along the duct's wall) is a few millimeters square. Mechanical working of the wall will allow easy manufacture thereof.

Figure 4:
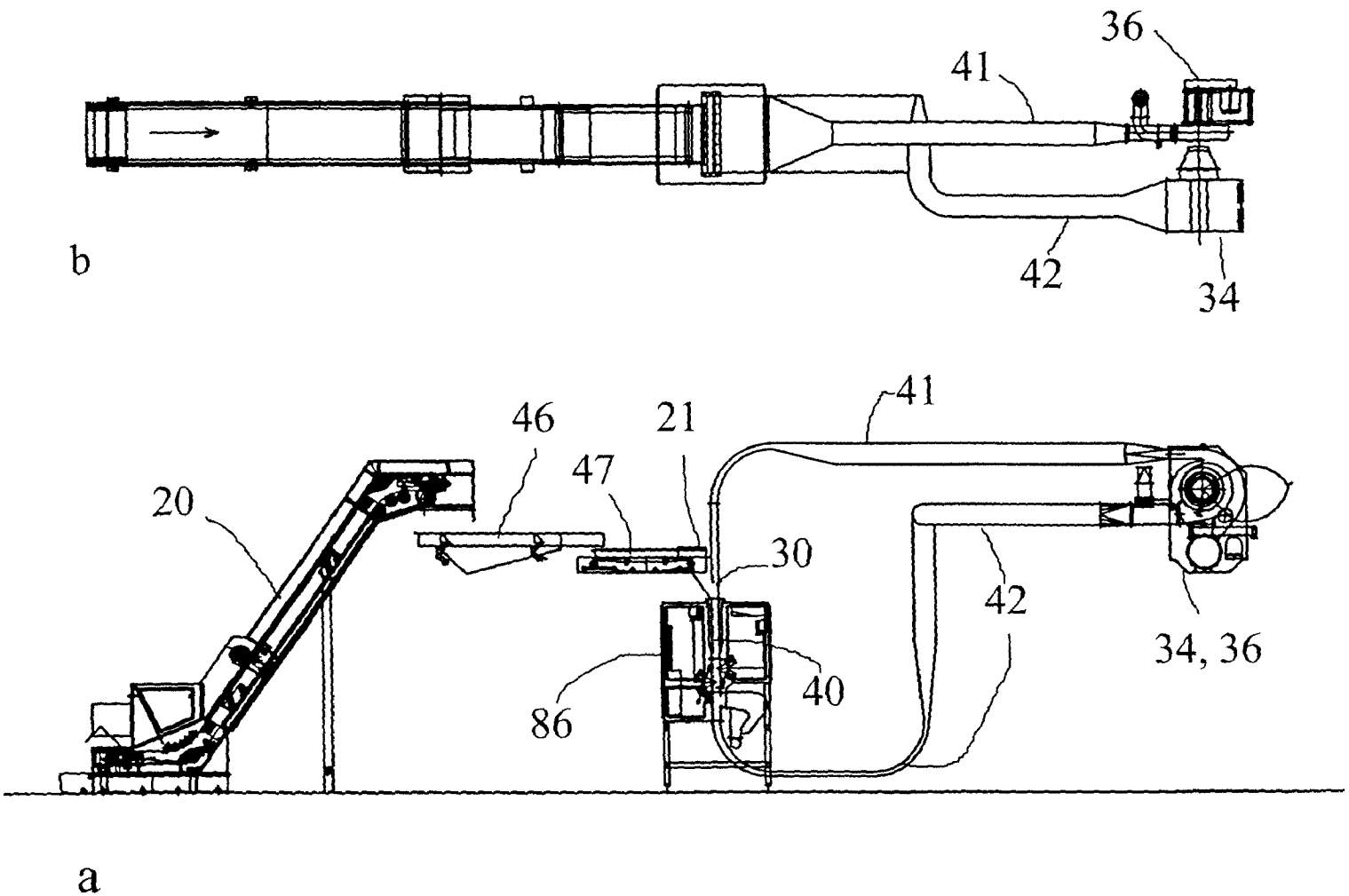
FIG. 4, an overall set-up of another sorting system according to the invention.

FIG. 4 shows an overall set-up of another sorting system according to the invention. As in the example of FIG. 1 the a figure shows a side view and the b figure shows a top view. The feeding conveyer 20 feeds the articles to a vibrating plate 46 that forms a uniform layer of the articles and the latter feeds the articles to a speedy tape transporter 47 that reduces the thickness of the layer of articles. The articles then are fed into the feeding chute 21 where below indication 30 the articles enter an inspection/separation duct 40 that is positioned within housing 86. Again duct 40 forms a part of a quasi-closed system comprising tubes 41,42 that connect the duct 40 to air-operated product separator arrangement 34 which is connected to air pump arrangement 36. In this case the articles are sucked into the duct 40 by an under-pressure that is created in tube 42.

Figure 5:
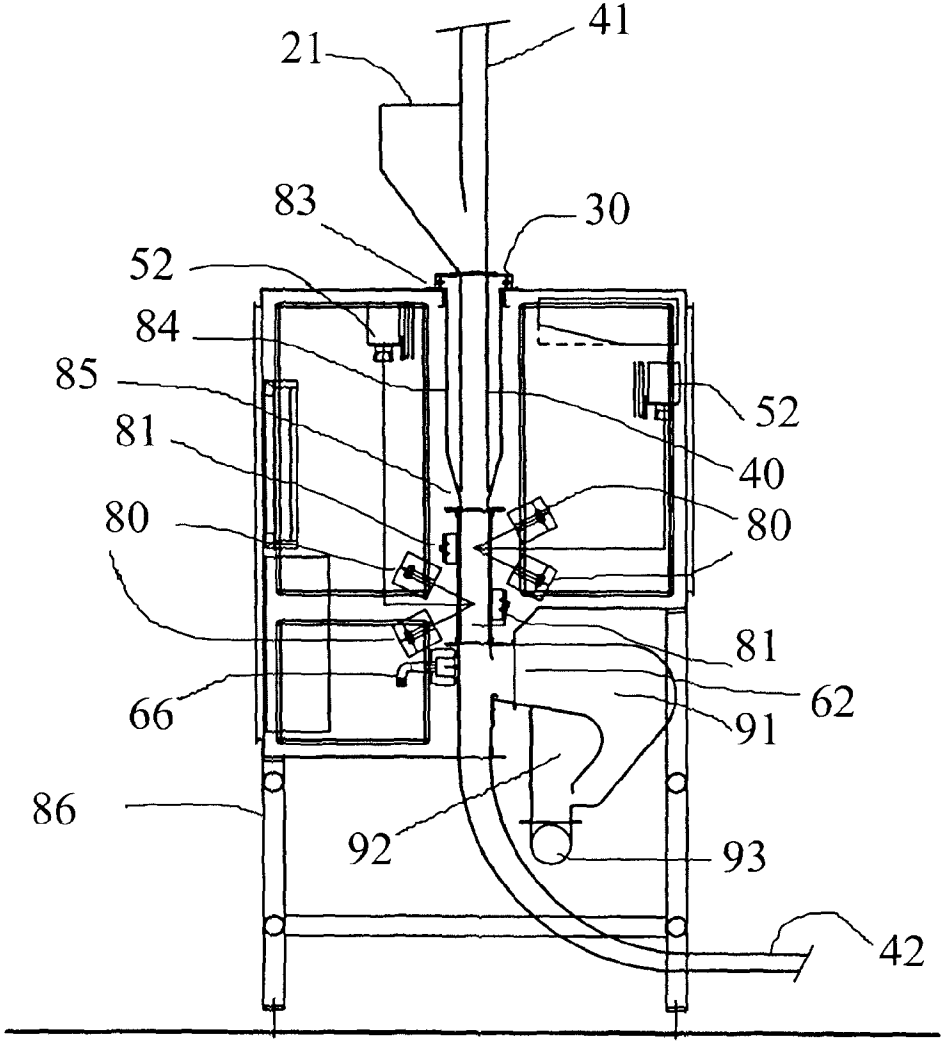
FIG. 5, an enlarged view of a part of the system of FIG. 4.

FIG. 5 illustrates an enlarged view of a part of the system of FIG. 4 comprising duct 40 below point 30 and chute 21. The upper part of the duct 40 is here over a length of about 1 meter laterally bordered by a cover tube 84 which feeds though a throttle-valve 83 a leakage air flow into duct 40 at location 85, below which the inspection and separation of impurities and unwanted articles takes place in a further part of duct 40 having a length of e.g. about 0.5 meter. The effect of said leakage airflow is illustrated in FIG. 6.

Figure 6:
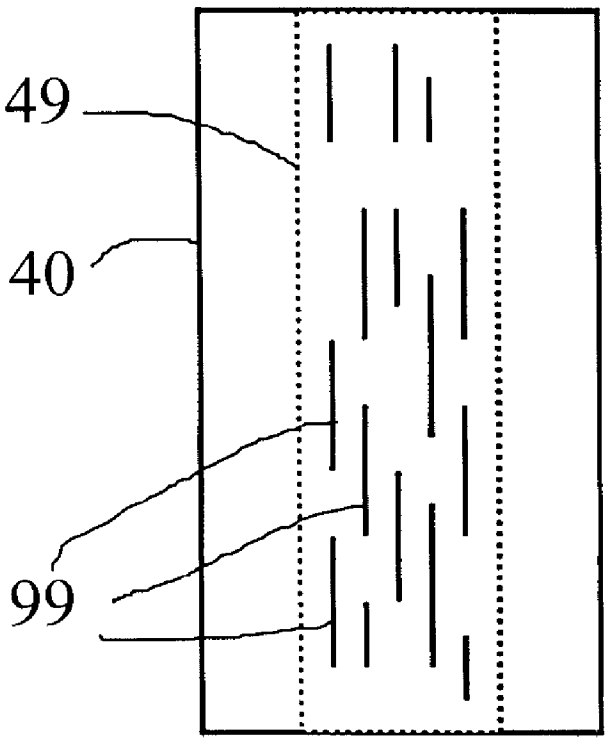
FIG. 6, two cross-sections of the part of FIG. 5 at different heights.
Figure 6:
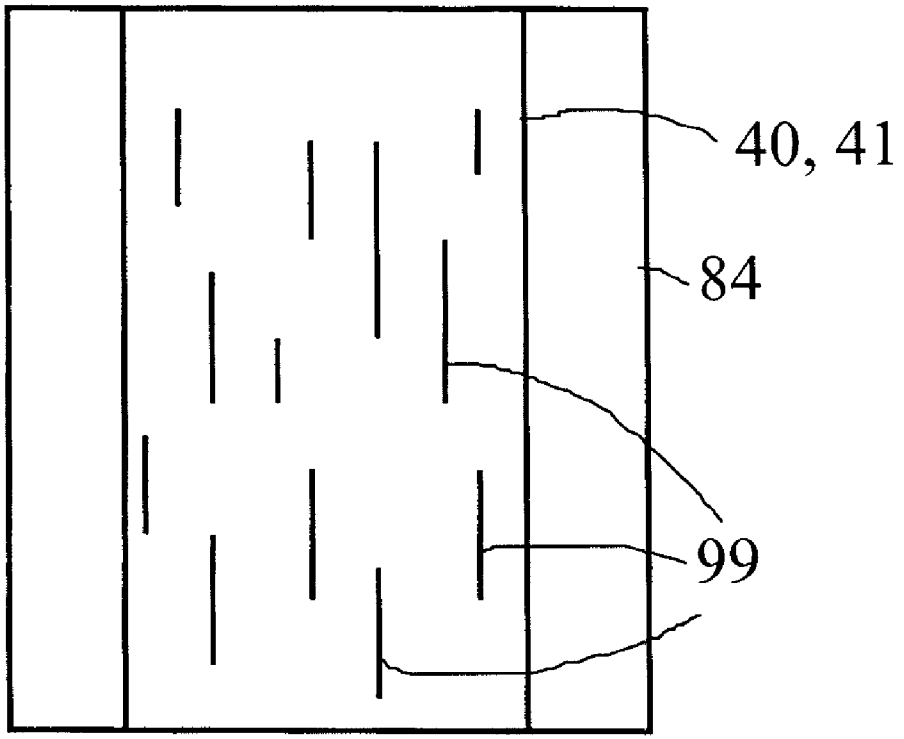

FIG. 6 shows two cross-sections of the part shown in FIG. 5 at different heights. The a and b FIG. 6 are taken respectively above point 85 and below point 85 in FIG. 5. In the upper part of duct 40 (see FIG. 6*a*) the particles 99 are present all over the cross-section of duct 40, their main orientation being parallel to wall 41 of duct 40. Below level 85 the leakage air flow is introduced into the duct 40, flows along the walls thereof and forms a compartment 49 in duct 40 with a smaller width, into which compartment the articles 99 are confined. This has several advantages. Firstly, the walls of duct 40 which contain transparent parts below level 85 are kept free from impurities that may hamper the inspection. Secondly the layer of particles 99 is provided with a more uniform velocity distribution, which is important to enable an accurate timing between the observance of a bad particle and the moment of its separation. Thirdly, the focusing into the particles 99 has become easier since the layer thickness of the stream of particles 99, which corresponds with the width of compartment 49 in FIG. 6*b*, is decreased.

Below level 85 (see FIG. 5 once more) the inspection and separation of particles is performed in housing 86. The inspection takes place through two optical detection systems, in this example two camera's 52 that observe the reflected light from a particle in duct 40. Two radiation sources, here lamps 80 are used for each camera 52 that throw angled radiation, here light, beams on the particle stream in order to reduce a possible shadow effect, if any. Radiating units 81 comprising LEDs (=Light Emitting Diodes) emitting radiation, in this example white light, provide a reference radiation beam for the optical detection systems such as camera's 52 in this example. After inspection, the removal of unwanted particles is accomplished by gas nozzle 66 by which such particles are ejected into a side-chamber 91 of the duct 40 which is through tube 93 connected to a reject enclosure and a separate air pump, the latter both not shown in the drawing. Anti back-flow arrangement 92, which here involves a so-called snail-shell construction of underpressure facility 62, prevents ejected particles from re-entering duct 40. In addition chamber 91 can be advantageously provided with an over pressure valve—also not shown in the drawing—which contributes to the prevention of re-entrance of ejected particles to duct 40 in case of pressure fluctuations. The over pressure valve can be provided with a particle filter and can be used together with a pump connected to tube 93 or in stead of such a pump. In stead of an over pressure valve a ventilator may be connected to chamber 91.

Now, the present invention has hereabove been disclosed with reference to preferred embodiments thereof. Persons skilled in the art will recognize that numerous modifications and changes may be made thereto without exceeding the scope of the appended claims. For example, the optical inspection and subsequent selection could be effected in a substantially vertical rising air stream.

Still further, the overall apparatus could be based on an open channel organization. This will obviate the need for various gas input/output balancing configurations. In that case, conveyor belt 20 (FIG. 1) could immediately feed duct 30 in FIG. 2. Where in the embodiments lamps are used for the optical inspection, the use of one or more lasers is feasible as well. Furthermore, the arrangement could need only a gas suction facility at the downstream end of the inspection/sorting channel prior to indication 68 in FIG. 2. Obviously, this would produce a low-cost arrangement as compared with the embodiment of FIG. 2. In consequence, the embodiments should be considered as being illustrative, and no restriction should be construed from those embodiments, other than as have been recited in the claims.

Finally, it is noted that elements of the various embodiments could be combined. The unit of FIG. 5 could e.g. be used in the system of FIG. 1, the bypass of FIG. 2 could be used in system of FIG. 4 and details of the unit of FIG. 2 could be used in the unit of FIG. 5 and vice versa.

The invention claimed is:

1. A method for sorting a gas-driven stream of generally flat and light-weight articles of varying dimensions comprising the steps of:

feeding said stream of generally flat and light-weight articles to a sorting facility;

orienting said generally flat and light-weight articles by using a downwardly inclined separation plate having air transmission holes through a centrifugal force which orients said generally flat and light-weight articles towards a sloping wall in a transition to a straight movement, said straight movement being substantially vertical in a falling direction, and wherein impurities pass through the air transmission holes;

executing said sorting by executing an optical inspection and upon so finding a non-conforming article removing the latter from the stream, wherein said inspection and said sorting are executed during said substantially straight movement of said generally flat and light-weight articles, and in that said removing is executed by means of gas driving in a direction substantially transverse to said straight movement, and wherein said removing by means of gas driving is effected through suction.

2. The method as claimed in claim 1, and being specifically dimensioned for sorting tobacco products including leaves or parts thereof and stems.

3. An apparatus comprising a sorting facility for sorting a gas-driven stream of generally flat and light-weight articles of varying dimensions through use of an optical inspection facility that activates a removal facility for upon finding a non-conforming article removing the latter from the stream, wherein said inspection facility and said removing facility of said apparatus are arranged for operating during a substantially straight movement of said generally flat and light-weight articles and wherein said removal facility is arranged for removing non-conforming articles through gas driving in a direction substantially transverse to said straight movement, wherein said optical inspection facility is preceded by an orientation facility comprising a downwardly inclined separation plate having air transmission holes for orienting said generally flat and light-weight articles through a force being selected from the group consisting of: a) a centrifugal force, or b) an air suction force , or c) a centrifugal force and d) an air suction force, said force being adapted to orient said generally flat and light-weight articles towards a slanting wall that functions as a transition to the straight movement section, wherein said apparatus further comprises a substantially vertically oriented duct being fed with said generally flat and light-weight articles and in which said straight movement of said generally flat and light-weight articles is effected in a falling direction and wherein said removal facility comprises a gas vacuum facility supplying a suction force via said substantially vertically oriented duct.

4. The apparatus as claimed in claim 3 being specifically dimensioned for sorting tobacco leaves or parts thereof.

5. The apparatus as claimed in claim 3 wherein said inspection facility and said removal facility are arranged in sequence along a falling direction of said articles.

6. The apparatus as claimed in claim 3, wherein said slanting wall is associated to a gas transmittal facility that recycles transmitted gas to a downward merging point fed by an output that carries useful particles transmitted through said apparatus.

7. The apparatus as claimed in claim 3, wherein said substantially vertically oriented duct has a channel wall containing wall-borne extensions to keep said articles from moving along the channel wall.

8. The apparatus as claimed in claim 3, wherein said substantially vertically oriented duct furthermore is provided with airflow means that operate to confine said articles in a smaller compartment within the substantially vertically oriented duct.

* * * * *